United States Patent [19]

Takeda et al.

[11] Patent Number: 4,895,830

[45] Date of Patent: Jan. 23, 1990

[54] SUBLIMATION TYPE THERMAL INK TRANSFER PRINTING MATERIAL

[75] Inventors: Naohiro Takeda, Yokohama; Yuzo Otani, Tokyo; Nariaki Okajima; Yoshihiko Ito, both of Yokohama; Shin-ichi Kinoshita, Yokohama, all of Japan

[73] Assignee: Diafoil Company, Ltd., Tokyo, Japan

[21] Appl. No.: 291,148

[22] Filed: Dec. 28, 1988

[30] Foreign Application Priority Data

Dec. 28, 1988 [JP] Japan ..... 62-334960

[51] Int. Cl.[4] ..... B41M 5/035; B41M 5/26

[52] U.S. Cl. ..... 503/227; 8/471; 428/195; 428/480; 428/483; 428/913; 428/914

[58] Field of Search ..... 8/471; 428/480, 913, 428/914, 483; 503/227

[56] References Cited

U.S. PATENT DOCUMENTS 4,695,288 9/1987 Ducharme ..... 503/227

*Primary Examiner*—Bruce H. Hess

*Attorney, Agent, or Firm*—Oblon, Spivak, McClelland, Maier & Neustadt

[57] ABSTRACT

There is disclosed a sublimation type thermal ink transfer recording material comprising a biaxially drawn film substrate consisting of a polyester base film and an applied primer layer of a reaction product of a polymerizable compound having carbon-carbon unsaturated bonds and a polyester, said substrate being drawn after a solution containing said reaction product is applied on the polyester film; a layer of sublimation type ink formed on said applied layer; and a slippery layer formed on the side opposite to said ink layer. This material has an ink layer which is not easily peeled off and has excellent image-forming ability.

3 Claims, 3 Drawing Sheets

SUBLIMATION TYPE THERMAL INK TRANSFER PRINTING MATERIAL

FIELD OF THE INVENTION

Figure 1:
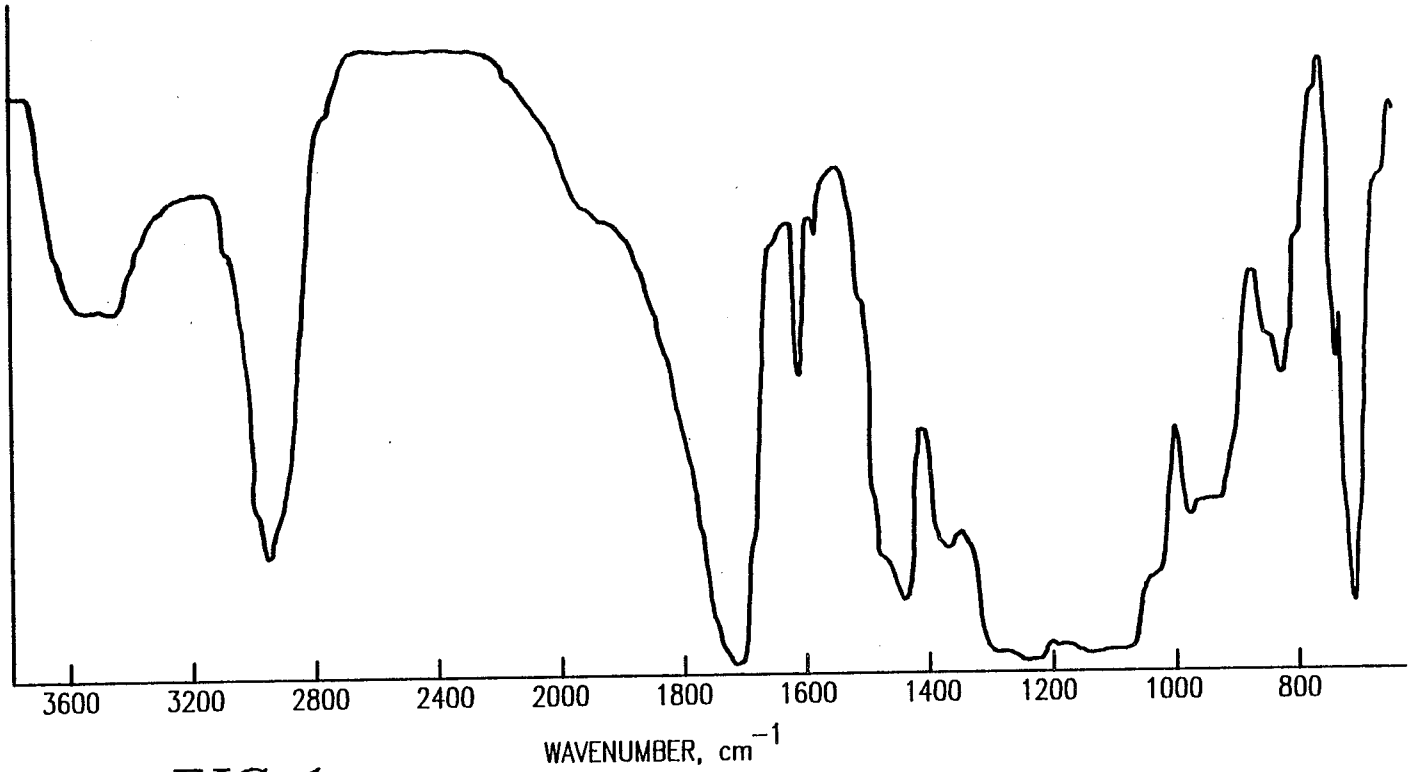

This invention relates to a thermal ink transfer printing film.

BACKGROUND OF THE INVENTION

The thermal ink transfer printing system is now being widely employed and improved as a quiet printing system for printers of office machines and other various fields. The thermal ink transfer printing system, especially the sublimation type thermal ink transfer system, in superior to the melting ink transfer system in that tone gradation can be easily and accurately reproduced, and therefore development of this system is proceeding for application in the image copying systems for video printers and the like. With a sublimation type ink, however, reproduction of tone gradation is difficult when the binder of the sublimation type ink layer has excessively high affinity to the substrate film, since the ink cannot be easily sublimed. When a binder which is suitable to sublimation type ink is selected, sometimes the adhesion of the ink layer to the substrate film is impaired and the whole ink layer is transferred to the image receiving sheet. In order to improve adhesion of the ink layer and the base film, and achieve an accurate transferred image (faithful reproducibility of the original), usually a primer layer is provided. However, it is essential to select a good primer layer, which is thin and uniform in thickness and has good adhesiveness to both the polyester base film and the ink layer.

In forming a primer layer on a polyester film, there is a problem that the polyester film is very thin, usually 3–7$\mu$, and therefore it is difficult to handle it and to apply a primer with high accurately. Accordingly, the yield of production of such printing films is very low.

We noted the fact that the applied primer layer can be made thinner and more uniform if the primer material is applied onto the polyester base film and thereafter the coated base film is stretched, and found that a good printing film can be produced by employing the above-mentioned post-application stretching and selecting a suitable primer material which has good adhesiveness to the binder for the ink layer and the primer material. Thus we accomplished the present invention.

DISCLOSURE OF THE INVENTION

The invention provides a sublimation type thermal ink transfer printing material comprising a biaxially drawn film substrate consisting of a polyester base film and an applied coated layer of a reaction product of a polymerizable compound having carbon-carbon unsaturated bonds and a polyester, said substrate being drawn after said coated layer has been applied on the polyester base film; a layer of sublimation type ink formed on said applied layer; and a slippery layer formed on the side opposite to said ink layer.

The term "polyester" as used in the phrase "drawn film substrate consisting of a polyester base film . . . " in the above passage of the specification means a poly(ethylene terephthalate) material which comprises 80% or more ethylene terephthalate or a poly(ethylene naphthalate) material which comprises 80% or more ethylene naphthalate.

The polyester film used in the above context may contain inorganic particles, organic particles, organic lubricants, antistatic agents, stabilizers, dyes, pigments, and organic polymers as components as desired. Usually, fine particles (protrusion formers) are incorporated in polyester films in order to improve their slidability. The species, size, content, etc. of the protrusion former are appropriately selected in accordance with the characteristics such as slidability, transparency, etc. required in the products.

The "polymerizable compound having carbon-carbon double bonds" mentioned in the present specification includes (meth)acrylate alkyl esters such as methyl (meth)acylate, hexyl (meth)acrylate, etc.; hydroxyalkyl esters of $\alpha,\beta$-ethylenically unsaturated carboxylic acids such as 2-hydroxyethyl acrylate, etc.; $\alpha,\beta$-ethylenically unsaturated carboxylic acids such as acrylic acid, crotonic acid, etc.; epoxy compounds such as glycidyl (meth)acrylate, (meth)acrylglycidyl ether, etc.; amide compounds such acrylamide, diacetoneacrylamide, N-methylolacrylamide, 2-acrylamide-2-methylpropanesulfonic acid; etc.; halogenated vinyl compounds such as vinyl chloride, vinylidene chloride, vinyl fluoride, etc.; esters of unsaturated dicarboxylic acids such as dibutyl maleate, etc.; styrenes; acrylonitriles; N-vinylpyrrolidone, N-vinylpyridine; vinyl esters such as vinyl acetate; perfluoroalkyl-containing compounds such as perfluorocyclohexyl acrylate; silicon compounds such as $\alpha$-methacryloxypropyltrimethoxysilane; phosphorus-containing vinyl compounds such as 2-acryloyloxyethyl acid phosphate; dialkylaminoalkyl acrylates such as dimethylaminoalkyl acrylate; ethylenesulfonic acid, styrenesulfonic acid, and derivatives thereof; cationic compounds such as 2-acryloyloxyethyltrimethylammonium chloride; so-called macromonomers which function as polymerizable monomers though being polymers per se; conjugated dienes such as butadiene; etc. However, the polymerizable compounds having carbon-carbon unsaturated bonds are not limited to the above-listed.

The polyster which is to be reacted with the above-described polymerizable compound having carbon-carbon unsaturated bonds should be soluble or dispersible in water or organic solvents. In other words, the reaction between said polymerizable compound and said polyester may occur in a homogenous system or an inhomogeneous system. For instance, if the polyester is dispersed in a medium, the so-called shell-core structure will be formed, which comprises nuclei of the dispersed polyester particles and crusts formed of the compound having carbon-carbon unsaturated bonds. The polyester may be saturated, unsaturated; ionic or nonionic. For instance, the saturated nonionic polyester may be those comprising, as the carboxylic acid moiety, an aromatic dicarboxylic acid such as terephthalic aid, isophthalic acid, 2,5-naphthalene-dicarboxylic acid, etc.; an aliphatic dicarboxylic acid such as adipic acid, azelaic acid, sebacic acid, an oxycarboxylic acid such as oxybenzoic acid, and ester-forming derivatives thereof; and, as the glycol moiety, an aliphatic glycol such as ethylene glycol, 1,4-butanediol, diethylene glycol, triethylene glycol, etc.; an alicyclic glycol such as 1,4-cyclohexanedimethanol, etc.; an aromatic diol such as p-xylenediole, etc.; a poly(oxyalkylene)glycol such as polyethyleneglycol, polypropylene-glycol, polytetramethylene glycol, etc. These polyesters are linear. But branched polyesters formed by using ester-forming agents having a valency of 3 or more can be used.

It is desirable to form polyesters having improved water-dispersibility or water-solubility by introducing ionic groups thereinto. As ionic groups to be introduced, anionic groups are preferred and sulfonic acid and carboxylic acid, or salts thereof can conveniently be used.

The sulfonic acid salts and carboxylic acid salts referred to in the above may be ammonium salts; amine salts such as salts of methylamine, ethanolamine, etc.; metal salts such as lithium salt, sodium salt, potassium salt, magnesium salt; etc. Polyesters containing sulfonic acid salt groups such as disclosed in JP-B-47-40873, JP-A-50-83497, JP-A-121336, JP-A-52-155640, etc. and similar polyesters can be used. Introduction of sulfonic acid salt groups can be effected by adding a metal salt of sulfoisophthalic acid, sulfoterephthalic acid, 4-sulfonaphthalene-2,7-dicarboxylic acid or ester-forming derivatives thereof during ester exchange reactions or polymerization so as to effect copolymerization; by sulfonating unsaturated groups of polyesters, which are copolymers with an ester-forming aliphatic unsaturated compound, with a sulfonating agent such as sodium hydrogen sulfite, sodium metasulfite, etc.; by grafting styrenesulfonic acid salt, methacrylsulfonic salt, etc. on a polyester using a radical initiator; etc. Carboxylic acid salt groups can be introduced by reacting a dioxy compound having a caboxylic acid group with a polyester as disclosed in JP-A-61-228030; or by introducing acrylic acid salt groups, methacrylic acid salt groups, etc. using a radical initiator, etc.

As unsaturated polyesters, those retaining copolymerizable unsaturated groups in the backbone chain of a resin which are obtained by reacting a starting material having copolymerizable unsaturated groups as an essential component and other starting materials, as disclosed in JP-45-2201, 46-20502, 44-7134, JP-A-48-78233, 50-58123, etc.; those which are obtained by reacting a saturated polyester having no polymerizable unsaturated groups but having functional hydroxyl, carboxyl groups, etc. and a vinyl monomer that has vinyl groups and other functional groups reactable with the hydroxyl, carboxyl groups etc. of said saturated polyester such as a monomer having an epoxy group and a vinyl group, for instance, glycidyl (meth)acrylate; a monomer having an alkoxysilanol group and a vinyl group, for instance vinylmethoxysilane, (meth)acryloxyethyltrimethoxy-silane, etc.; a monomer having an acid anhydride group and a vinyl group, for instance, maleic anhydride, tetrahydrophthalic acid anhydride, etc.; a monomer having an isocyanate group and a vinyl group, for instance, an equimoral adduct of 2-hydroxypropyl (meth)acrylate and hexa-methylene diisocyanate, as disclosed in JP-A-49-47916, 50-6223, etc. can be used. However, the unsaturated polyesters are not limited to the listed above.

The reaction products of a compound having carbon-carbon unsaturated bond and a polyester of the present invention can be obtained by mixing a polyester dissolved or dispersed in water or a solvent with the compound having carbon-carbon unsaturated bond, carrying out copolymerization by a process known per se using a polymerization initiator such as hydrogen peroxide, benzoyl peroxide, tert-butyl peroxide, di-tert-butyl peroxide, acetyl peroxide, azo-bis-isobutyronitrile, cumene hydroperoxide, ammonium persulfate, potassium peroxide, 2,2-azo-bis-aminodimethane, 2,2-azo-bis-aminoethane, or hydrochloric acid salt or sulfuric acid salt thereof, cerium(IV) ammonium nitrate; or a photopolymerization initiator such as 2-hydroxy-2-methyl-1-phenylpropane-1-one, 1-(4-isopropylphenyl)-2-hydroxy-2-methylpropane-1-one, etc. However, the preparation method is not limited to those mentioned above.

The content of the polyester in the reaction product of the compound having polymerizable carbon-carbon unsaturated bonds and a polyester of the present invention varies in accordance with the characteristics required in the resulting products, although it is preferably 5–95% by weight, more preferably 10–80% by weight. When the polyester content is less than 5% by weight, the adhesion to the polyester base film and the strength of the coated layer may be insufficient. When the polyester content is more than 95% by weight, the useful characteristics of the compound having polymerizable carbon-carbon unsaturated bonds may not be effectively manifested in the reaction product.

The coating material of the present invention can be used in the form of a solution in an organic solvent, although it is preferably used in the form of an aqueous solution or dispersion when used for the method wherein the polyester film is drawn after the coating material has been applied. In order to make the reaction products water-soluble or water-dispersible, polyesters containing hydrophilic groups such as anionic groups can be used, or hydrophilic compounds having polymerizable carbon-carbon unsaturated bonds can be used. This can be effected by methods known per se. In the present invention, water is preferred as a medium for the coating material. Organic solvents such as alcohols, cellosolves, N-methylpyrolidone, etc. can be admixed with water in order to improve the coagulation stability of the coating material, the coatability of the coating fluid, film-forming property of the coating fluid.

The coating fluid of the present invention may contain methylolated or alkylolated urea, melamine compounds, guanamine compounds, acrylamide compounds, polyamide compounds, epoxy compounds, aziridine compounds, block polyisocyanate, silane-coupling agents, titanium-coupling agents, zirco-aluminate coupling agents, vinyl compounds of of which reactivity can be activated by heat, peroxide or actinic radiations; photosensitive resins for the improvement of blocking properties, water resistance, solvent resistance, mechanical strength, etc. of the coated layer. The coating fluid also may contain inorganic particles such as silica, silica sol, alumina, alumina sol, zirconium sol, kaolin, talc, calcium carbonate, titanium oxide, barium salts, carbon black, molybdenum sulfide, antimony oxide sol, etc. for the improvement of blocking properties, lubricity, etc. The coating fluid further may contain defoaming agents, spreadability improvers, thickening agents, antistatic agents, organic lubricants, organic polymer particles, antioxidants, ultraviolet absorbers, foaming agents, dyes, pigments, etc. as desired. The coating fluid of the present invention still further may contain polymers other than the above-described polymers for the improvement of properties of the coating fluid or the coated layer.

The above-described coating fluid can be applied to unstretched polyester base film by a reverse roll coater, gravure coater, rod coater, air doctor coater, or the like as described in "Kotingu Hoshiki (Coating Method)" by Yuji Harasaki published by Maki Shoten (1979). The polyester base film can be treated by various methods. For instance, the film can be first coated and then sequentially or simultaneously biaxially stretched. Or the film can be first stretched longitudinally and then coated, and the coated film can be stretched transversely. Or the film can be first biaxially stretched and then coated and further stretched longitudinally and/or transversely.

The above-described stretching is carried out preferably at 60°-130° C., and the ratio of stretching is at least 4 times in area, preferably 6-20 times. The stretched film is heat-treated at 150°-250° C.

It is preferable to relax the stretched film by 0.2-20% in the highest temperature zone and/or in the cleaning zone at the exit of the heat-treatment apparatus.

In a preferred process, the polyester film is stretched at 60°-130° C. by a factor of 2-6 by roll drawing in one direction, coated with the coating fluid, suitably dried, or not dried, stretched in the direction transverse to the previous stretching by a factor of 2-6 at 80°-130° C., and finally heat-treated at 150°-250° C. for 1-600 sec.

According to the present invention, drying of the coated layer can be effected simultaneously with stretching, and the thickness of the coated layer can be reduced in proportion to the factor of stretching, and thus desirable polyester substrate can be economically manufactured.

In the present invention, the coating fluid can be applied only on one side or on both sides of a polyester base film. When applied only on one side, it is possible to provide the polyester film with other characteristics by applying a coating fluid other than that of the present invention to the other side.

The polyester base film can be subjected to a chemical treatment or electric discharge treatment prior to coating in order to improve coatability, adhesion thereto of the coating material, etc.

The biaxially stretched polyester film which has been coated, that is, the substrate film can be subjected to electric discharging treatment in order to improve adhesion, coatability, etc. of the coated layer.

The polyester substrate obtained by coating the coating material of the present invention should preferably comprise a base film having a thickness of 1-10μ and a coated layer having a thickness of 0.01-1μ, more preferably 0.02-0.5μ. When the thickness of the coated layer is less than 0.01μ, a uniform coated layer cannot be easily formed, and when the thickness is more than 1μ, accuracy of the reproduction of an image with the sublimation type ink is impaiared.

The term "sublimation type ink layer" in the present invention means sublimable solid dye of yellow, magenta and cyan dispersed in a binder. Typical examples of the sublimable dyes are as follows:

Yellow: Color Index Diperse Yellow 7 e.g., Palanyl Yellow-5RX (trade name) supplied by BASF Magenta: Color Index Disperse Red 60 e.g., Sumicalon RED-FBL (trade name) supplied by Sumitomo Chemical Co.

Cyan: Color Index Solvent Blue 108.

Sublimable dyes which rapidly sublime in a narrow temperature range in the proximity of the suitable transfer temperature are most suitable. Most of the dyes which are suitable for thermal transfer printing have a molecular weight of 230-370. The dyes having this range of molecular weight are not only suitable in sublimability but also easily diffuse into the materials to be dyed. Dyes having a structure which does not contain ionic groups such as sulfonic acid group, carboxyl group, etc. but contains a suitable amount of polar groups such as hydroxyl group, amino group, nitro group, sulfon group, etc. are preferred.

As binders for sublimation type ink layers, those which allow uniform dispersion of dyes and quick sublimation of the contained dyes are preferred. These are cellulosic resins, acryl resins, polyvinyl alcohols, polyamides, etc., for example, but are not limited thereto.

The dye content in the sublimation type ink layer can be suitably determined by considering the characteristics required in the intended use, although, needless to say, the higher the content, the denser the color.

The thickness of the sublimation type ink layer is preferably 0.5-10μ, more preferably 1-5μ.

The "slippery layer" in the present invention is a layer which provides good slipping between the thermal head or the pin electrode (in the case of resistive films) and the printing film and is indispensable in the present invention. Particularly, when the thermal head is used, if the slippary layer is not provided, the film tends to be melted by the thermal head and fused thereto.

The slippary layer comprises a binder resin, particles which give coarseness to the surface and thus provide slipperiness to the film and a lubricant material which provides slidability and may further contain antistatic agents, etc. as desired. The binder resins can be provided with slidability by incorporation of silicone oils, or fluorine compounds. If the slippery layer is required to be provided with heat resistance, a so-called heat-resistive resin such as polyimide can used, although incorporation of fluorine resins or cross-linkable silicon resins are preferred. Also better heat resistance can be attained by enhancing cross-linking density by the employment of heat-settable resins, resins which can be cross-linked by UV rays, etc. The slippery layer can be formed by the coating-and-stretching method, but it is preferred to form said layer on the biaxially stretched polyester film when heat resistance is of primary importance, because the coating materials, cross-linking conditions, etc, can be selected from a broader range. The thickness of the slippery layer is preferably 0.05-5μ, more preferably 0.1-1μ.

The sublimation type thermal ink transfer printing material of the present invention has excellent image forming ability since the sublimation type ink layer firmly adheres to the polyester substrate and, therefore, the ink layer is not peeled off from the substrate and does not stick to the image-receiving sheet and enables quick sublimation of the dye.

BRIEF EXPLANATION OF THE ATTACHED DRAWINGS

Figure 2:
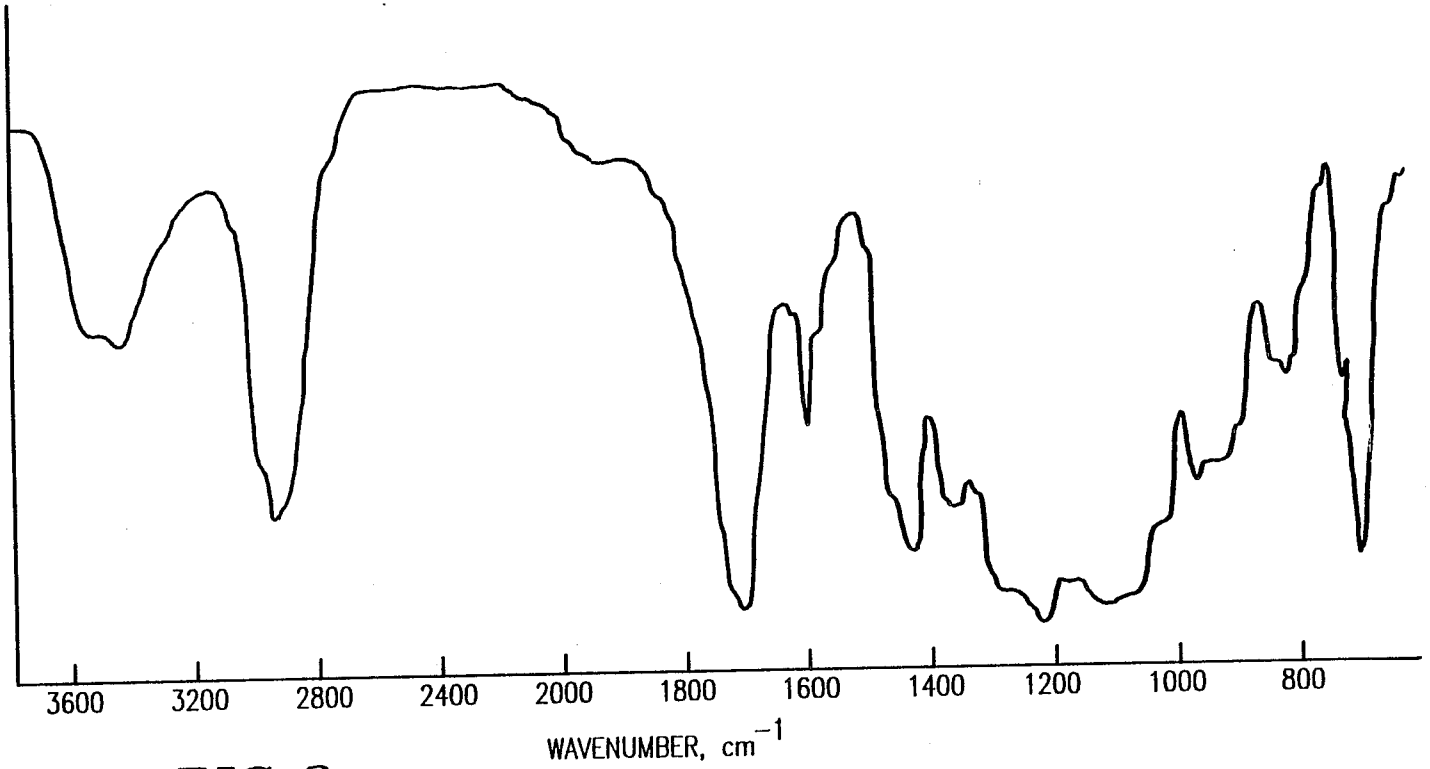
Figure 3:
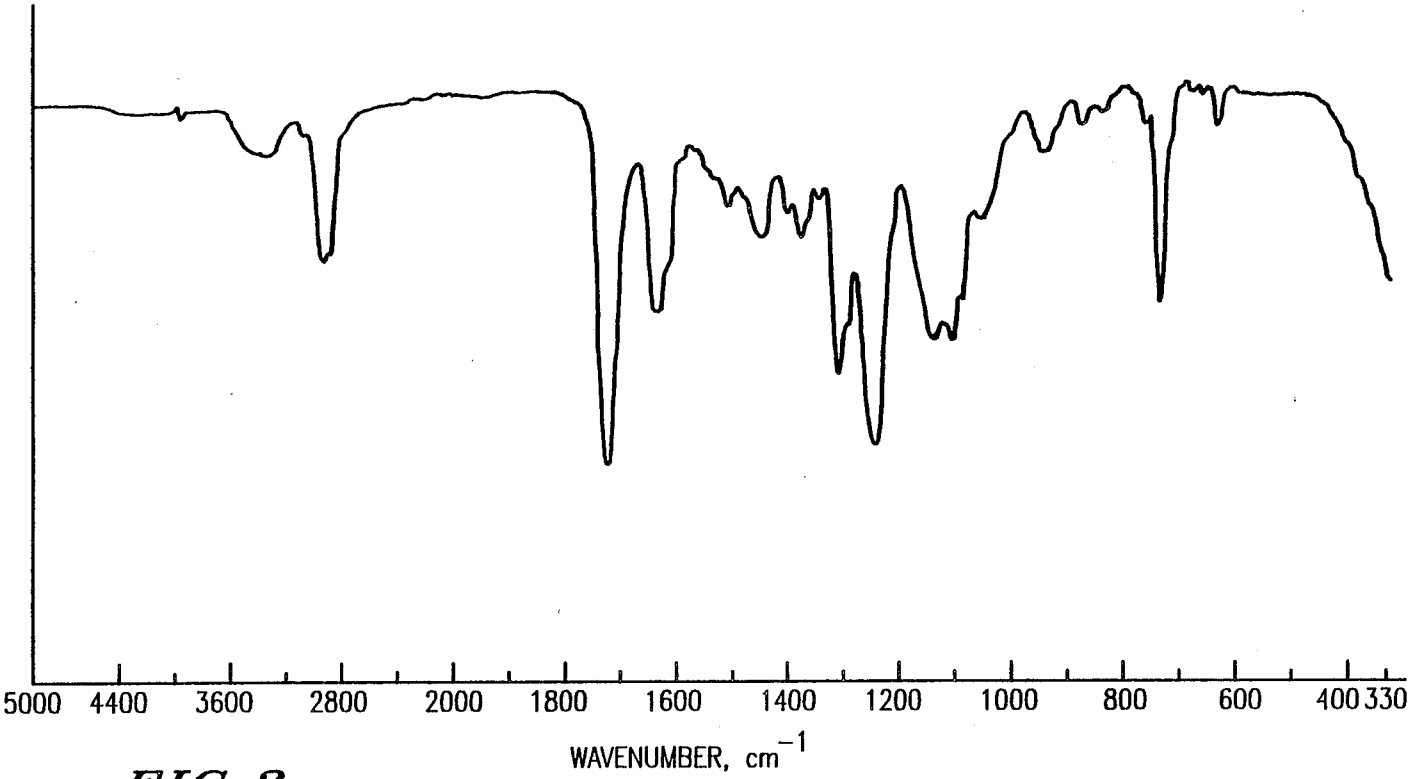

Of the attached drawings,

FIG. 1 is an IR spectrophotometric chart of the reaction product of an acrylate compound and a polyester "Pesresin A517" usen in Example 1, FIG. 2 is an IR spectrophotometric chart of the reaction product of an acrylate compound and a polyester "Pesresin A517G" usen in Example 2 and FIG. 3 is an IR spectrophotometric chart of the reaction product of an acrylamide compound and a polyester "NT-2" used in Example 3.

SPECIFIC DESCRIPTION OF THE INVENTION

Now the invention will be described specifically by way of working examples. However, the invention is not limited to the working examples only but various modifications are possibe within the gist of the claimed invention.

Methods of evaluation of the product employed in the examples are as follows.

(1) Peeling test

An adhesive tape ("Cellotape" (trade name) supplied by Nichiban, Ltd. or "Scotch Mending Tape 810" (trade name) supplied by 3M, Inc.) was applied onto the sublimation type ink layer and quickly removed, and peeling-off of said layer was observed.

(2) Transfer printing test

A thermal ink transfer printing film was placed on a sheet of an image-receiving paper which comprises 200μ thick wood-free paper the surface of which had been coated with a 5μ thick image-receiving layer consisting of 10 parts by weight (on the dry basis) of a polyester ("Vilonal MD-1200" (trade name, supplied by Toyo Spinning Co, Ltd.) and 1 part by weight of silica powder ("Nipsil E220A" (trade name) supplied by Nippon Silica Kogyo K.K.), and transfer printing was carried out using a thermal head having resistance heating units of 8 dots/mm density and applying power of 0.3W/dot for 10 milliseconds. The results were evaluated according to the following criteria.

(A) Whether the sublimation type ink layer itself was transferred or not was visually observed.

(B) The color density was measured with a densitometer ("Desitometer RD-514" (trade name) supplied by MacBeth, Inc.) and calculated as follows:

$$\text{Color density} = \log_{10}(I_0/I),$$

wherein $I_0$: Intensity of light reflected by a standard white sheet

I: Intensity of light reflected by the printed surface of the image-receiving paper.

EXAMPLE 1

A polyethylene terephthalate having an intrinsic viscosity of 0.63 was melted and extruded at 280°-300° C. onto a cooling drum to form a 50μ thick amorphous film. This film was longitudinally stretched at 95° C. by a factor of 3.5 and one side of it was coated with a coating fluid consisting of 90 parts by weight (on the basis of solid content) of a reaction product of an acrylate compound and a polyester ("Pesresin A517" (trade name) supplied by Takamatsu Yushi K.K.) and 10 parts by weight (the same as above) of alkylol melamine dispersed in water. The coated film was then transversely stretched at 110° C. by a factor of 3.5 and heat-treated at 215° C. and thus a biaxially stretched polyester substrate comprising a 4.1μ thick base film and an 0.11μ thick coated layer was obtained.

A 0.10μ thick slippery layer consisting of 86 parts by weight of polyimide derived from benzophenone-3,3',4,4'-tetracarboxylic acid anhydride, tolylene diisocyanate (80 mol%) and 4,4'-diphenylmethane diisocyanate (20 mol%), 7 parts by weight of calcium carbonate having an average particle size of 0.07μ and 7 parts by weight of a fluorine-containing silicone oil ("FL-100" (trade name) supplied by Shin'etsu Kagaku K.K.) was formed on the other side of the above-described coated film.

On the surface coated with the above-described coating material, a 1.5μ thick sublimation type ink layer consisting of 17 parts by weight of a dye represented by the chemical formula:

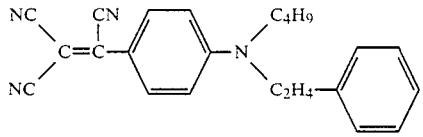

and 83 parts by weight of cellulose acetate ("L-30" (trade name) supplied by Daicel Chemical Industries, Ltd.) was provided to form a thermal ink transfer printing material.

The adhesion of the sublimation type ink layer and the substrate film of the thus obtained printing material was satisfactory in the above-described peeling test, that is, no peeling-off occurrred. In an actual transfer printing test, the adhesion of the ink layer and the substrate was satisfactory and no transfer of the ink layer to the image-receiving paper occurred. The color density of the printed part on the image-receiving paper in the overall uniform printing was 1.8, which is a practically satisfactory value.

COMPARATIVE EXAMPLE 1

A 4.1μ thick biaxially stretched polyester film was prepared, and a sublimation type thermal ink transfer printing material was obtained in the same manner as in Example 1 except that the primer layer was not provided.

The adhesion of the sublimation type ink layer and the substrate was unsatisfactory. That is, in the peeling-off test, the sublimation type ink layer was easily peeled off from the substrate film. In the transfer printing test, there was no substantial difference in color density from the product of Example 1 in the overall uniform printing. But observation of the transferred surface revealed that the ink layer was partially transferred. In the actual color printing (not overall printing), the parts where the ink layer was transferred were very poor in image accuracy and color tone, and the product was not suitable for practical use.

EXAMPLE 2

A polyethylene terephthalate having an intrinsic viscosity of 0.63 was melted and extruded at 280°-300° C. onto a cooling drum to form a 52μ thick amorphous film. This film was longitudinally stretched at 90° C. by a factor of 3.4 and one side of it was coated with a coating fluid consisting of 90 parts of by weight (on the basis of solid content) of a reaction product of an acrylate compound containing an epoxy group and a polyester ("Pesresin A517G" (trade name) supplied by Takamatsu Yushi K.K.) and 10 parts by weight (the same as above) of alkylol melamine dispersed in water. The coated film was then transversely stretched at 110° C. by a factor of 3.5 and further longitudinally stretched at 120° C. by a factor of 1.05. The thus stretched film was heat-treated at 220° C. and thus a biaxially stretched polyester film comprisng a 4.2μ thick base film and a 0.07μ thick coated layer was obtained.

A 0.6μ thick cured slippery layer was formed on the other side of the above-described coated film by coating it with a composition consisting of 85 parts by weight of a reaction product of 30 parts by weight of trimethylolpropane triacrylate, 70 parts by weight of pentaerythritol tetraacrylate, 2 parts by weight of dimethylolpolysiloxane ending with silanol groups on both ends and having a molecular weight of about 650, 1 part by weight of methylhydrogenpolysiloxane having a molecular weight of about 2500, 3 parts by weight of benzoylethylether, 0.1 part by weight of dibutyl tin dilaurate in ethyl acetate; 10 parts of benzoguanamine particles ("Epostar S" (trade name) supplied by Nippon Shokubai Kagaku K.K.); and 5 parts by weight of polyether-modified silicone ("DC11PA" (trade name) supplied by Toray Silicone, Ltd.) and irradiating with a metal halide lamp.

On the opposite side of the slippery layer, a 2.0μ thick sublimation type ink layer consisting of 10 parts by weight of "Kayaset B" (trade name, a dye, supplied by Nippon Kayaku K.K.), 15 parts by weight of cellulose acetate propionate, 2 parts by weight of silica gel, 1 part by weight of methylolmelamine was formed, and thus a thermal ink transfer printing material was prepared.

The adhesion of the ink layer and the substrate was satisfactory without peeling off in the peeling test. In the transfer printing test, no transfer of the ink layer occurred and color density and image accuracy were satisfactory.

EXAMPLE 3

A biaxially stretched polyeter substrate film consisting of a 4.1μ thick base film and a 0.15μ thick primer layer was prepared in the same manner as in Example 1 except that a reaction product of an acrylamide and a polyester ("NT-2" (trade name) supplied by Takamatsu Yushi K.K.) was used instead of the reaction product of an acrylate compound and a polyester used in Example 1. A sublimation type ink layer and a slippery layer was formed in the same manner as in Example 1 and thus a thermal ink transfer printing material was obtained.

The adhesion of the ink layer and the substrate was satisfactory without peeling off in the peeling test.

In the transfer printing test, there occurred no transfer of the ink layer, and the color density and the image accuracy were satisfactory.

We claim:

1. A sublimation type thermal ink transfer printing material comprising a biaxially drawn film substrate consisting of a polyester base film and an applied primer layer of a reaction product of a polymerizable compound having carbon-carbon unsaturated bonds and a polyester, said substrate being drawn after a liquid containing said reaction product is applied on the polyester film; a layer of sublimation type ink formed on said applied layer; and a slippery layer formed on the side opposite to said ink layer.

2. The sublimation type thermal ink transfer printing material as recited in claim 1; wherein the polymerizable compound having carbon-carbon unsaturated bonds is an acryl compound or a vinyl compound.

3. The sublimation type thermal ink transfer printing material as recited in claim 1, wherein the liquid is an aqueous dispersion.

* * * * *